US007399012B2

(12) United States Patent
Yoshimura

(10) Patent No.: US 7,399,012 B2
(45) Date of Patent: Jul. 15, 2008

(54) STRIKER AND STRIKER SYSTEM

(75) Inventor: Takeshi Yoshimura, Aichi (JP)

(73) Assignees: Toyota Jidosha Kabushiki Kaisha, Aichi-Ken (JP); Mitsui Mining & Smelting Co., Ltd., Tokyo (JP); Shiroki Corporation, Kanagawa-Ken (JP)

( * ) Notice: Subject to any disclaimer, the term of this patent is extended or adjusted under 35 U.S.C. 154(b) by 0 days.

(21) Appl. No.: 10/574,964

(22) PCT Filed: Aug. 26, 2004

(86) PCT No.: PCT/JP2004/012253

§ 371 (c)(1),
(2), (4) Date: Apr. 7, 2006

(87) PCT Pub. No.: WO2005/035912

PCT Pub. Date: Apr. 21, 2005

(65) Prior Publication Data

US 2007/0126247 A1 Jun. 7, 2007

(30) Foreign Application Priority Data

Oct. 10, 2003 (JP) ..... 2003-351556

(51) Int. Cl.
*E05B 15/02* (2006.01)
*E05B 15/00* (2006.01)

(52) U.S. Cl. ..... 292/340; 292/341; 292/341.12

(58) Field of Classification Search ..... 292/340, 292/341, 341.12
See application file for complete search history.

(56) References Cited

U.S. PATENT DOCUMENTS

| | | | | |
|---|---|---|---|---|
| 4,451,071 | A | 5/1984 | Striese et al. | |
| 5,125,698 | A * | 6/1992 | Thau | 292/216 |
| 5,494,208 | A * | 2/1996 | Granger | 228/173.6 |
| 5,501,495 | A * | 3/1996 | Claucherty | 292/340 |
| 5,927,774 | A * | 7/1999 | Granger | 292/340 |

(Continued)

FOREIGN PATENT DOCUMENTS

JP 5524281 6/1980

(Continued)

*Primary Examiner*—Carlos Lugo
(74) *Attorney, Agent, or Firm*—Millen, White, Zelano & Branigan, P.C.

(57) ABSTRACT

A striker locks two members by engagement with a groove of a hook, wherein the striker is fixed to one of the two members and the hook is rotatably fixed to the other of the two members. The striker includes a mounting plate portion fixed to the one of the two members; a base plate portion which is formed so as to extend perpendicular to the mounting plate portion by a bending process along a bend line; and a folded-back plate portion which is formed by folding over an extended portion. The folded back plate portion extends from one end of the base plate portion in a direction of the bend line, onto the opposite side of the base plate portion from the mounting plate portion side, so that the extended portion overlies the base plate portion. The base plate portion is positioned closer to the hook than the folded-back plate portion. A through-hole is formed in the base plate portion and the folded-back plate portion, which overlie each other, so that a folded end portion between the base plate portion and the folded-back plate portion defines a rod portion serving as an engaging portion engageable with a groove of the hook.

10 Claims, 6 Drawing Sheets

U.S. PATENT DOCUMENTS 6,095,577 A * 8/2000 Nolzen ..... 292/340
6,692,046 B2 * 2/2004 Paskonis ..... 292/340

FOREIGN PATENT DOCUMENTS

JP 5506920 4/1991
JP 07229345 A 8/1995
JP 7229345 A 8/1995
JP 2002-220956 8/2002

* cited by examiner

STRIKER AND STRIKER SYSTEM

FIELD OF THE INVENTION

The present invention relates to a striker and striker system, namely, the present invention relates to a striker and striker system for locking two members with each other by engagement of the striker with a hook, wherein the striker and the hook are fixed to the two members, respectively. The striker devised according to the present invention is used for locking, for instance, a car door to a car body.

BACKGROUND OF THE INVENTION

FIGS. 6A and 6B show two conventional strikers, respectively.

The striker shown in FIG. 6A includes a mounting plate portion 121 which is fixed to a car body and a base plate portion 122 which is formed (bent) upright relative to the mounting plate portion 121 by a bending process. A rod portion 123 is formed at one end (the right end as viewed in FIG. 6A) of the base plate portion 129 by making a through-hole 122 in the base plate portion 122 so that the rod portion 123 is used as an engaging portion engageable with a groove of an associated hook.

The striker shown in FIG. 6B includes two base plate portions 222 and 222' which overlie each other and a rod portion 223 which is formed at one end (the upper end as viewed in FIG. 6B) of each of the two base plate portions 222 and 222' by making a through-hole 229 in the two base plate portions 222 and 222', so that the rod portion 223 is used as an engaging portion engageable with a groove of an associated hook. The two base plate portions 222 and 222' are formed upright relative to two mounting plate portions 221 and 221' of the striker, respectively, by a bending process. In addition, the two base plate portions 222 and 222' are not separate plate members; the two base plate portions 222 and 222' are formed by bending a seamless plate along a portion thereof which is formed as the aforementioned rod portion 223.

Although substantially the same as the striker shown in FIG. 6B, a striker having two base plate portions (which respectively correspond to the two base plate portions 222 and 222') which are formed from separate plates is known in the art (this type of striker is disclosed in, e.g., Japanese unexamined patent publication H07-229345). In this conventional striker, the two separate plates that overlie each other are fixed to each other by spot welding.

To engage and disengage the striker with/from the groove of the associated hook smoothly, it is desirable that the rod portion be rounded off and have a large thickness (e.g., 3 to 7 millimeters, desirably 4 to 6 millimeters depending on factors such as the inner diameter of the groove of the associated hook). Namely, it is desirable that the rod portion have a round shape such as a circular shape in cross section (section taken along a plane orthogonal to the direction of the length of the rod portion) and that the rod portion have a large thickness (diameter).

DISCLOSURE OF THE INVENTION

Problem to be Overcome by the Invention

In the striker shown in FIG. 6A, the base plate portion 122 only has a thickness of a single plate, and accordingly, the rod portion 123 only has a thickness of a single plate. Therefore, it is impossible for the rod portion 123 to be formed so as to have the aforementioned large thickness and to have a circular shape in cross section. Note that an increase in thickness of the base plate portion 122 causes other problems such as an increase in weight and an increase in production cost, and therefore cannot be adopted.

In the striker shown in FIG. 6B, the two base plate portions 222 and 222' are made by overlaying two plate portions on each other, and accordingly, the rod portion 223 can be formed to have the aforementioned large thickness and a round shape such as a circular shape in cross section. However, since the two base plate portions 222 and 222' have the two mounting plate portions 221 and 221', respectively, there are problems with the striker being heavy and having a production cost, Additionally, since the direction of bending the mounting plate portion 221 and the base plate portion 222, the direction of bending the two base plate portions 222 and 222', and the direction of bending the base plate portion 222' and the mounting plate portion 221' are mutually different, it is quite difficult to carry out these three bending operations successively.

In the striker disclosed in Japanese unexamined patent publication H07-229345, there is no such difficulty in bending; however, the problem of the striker being heavy still remains. Moreover, there is another problem with the manufacturing process of this striker being complicated and costly because an additional manufacturing operation, i.e., a spot welding operation, needs to be carried out. Accordingly, a problem in production of the striker also exists.

The present invention provides a low-cost striker which has the aforementioned thickness (e.g., 3 to 7 millimeters, desirably 4 to 6 millimeters, depending on factors such as the inner diameter of the groove of the associated hook), and a round shape such as a circular shape in cross section, via a simple manufacturing operation with no substantial increase in weight of the striker.

Means to Overcome the Problem

According to an aspect of the present invention, a striker is provided for locking two members with each other by engagement of the striker with a groove of a hook, wherein the striker is fixed to one of the two members and the hook is rotatably fixed to the other of the two members, the striker including a mounting plate portion fixed to the one of the two members; a base plate portion which is formed so as to extend perpendicular to the mounting plate portion by a bending process along a bend line; and a folded-back plate portion which is formed by folding over an extended portion, extending from one end of the base plate portion in a direction of the bend line, onto the opposite side of the base plate portion from the mounting plate portion side, so that the extended portion overlies the base plate portion. The base plate portion is positioned closer to the hook than the folded-back plate portion. A through-hole is formed in the base plate portion and the folded-back plate portion, which overlie each other, so that a folded end portion between the base plate portion and the folded-back plate portion defines a rod portion serving as an engaging portion engageable with a groove of the hook.

Furthermore, according to another aspect of the present invention, a striker is provided for locking two members with each other by engagement of the striker with a groove of a hook, wherein the striker is fixed to one of the two members and the hook is rotatably fixed to the other of the two members, the striker including a mounting plate portion fixed to the one of the two members; a base plate portion which is formed so as to extend perpendicular to the mounting plate portion by a bending process along a bend line; and a rod portion which is formed by folding over an extended portion, extending from one end of the base plate portion in a direction of the bend line, onto the opposite side of the base plate portion from the mounting plate portion side, so that the folded over the extended portion defines a folded-back plate portion. The base plate portion is positioned closer to the hook than the folded-back plate portion. A through-hole is formed in the base plate portion so as to define the rod portion, the rod portion serving as an engaging portion engageable with a groove of the hook.

It is desirable that a first portion of a cross section of the rod portion at the folded end portion which is taken along a plane orthogonal to the direction of the length of the rod portion be greater in length than a second portion of the same cross section of the rod portion, wherein the first portion and the second portion are located on the base-plate-portion side and the folded-back-plate-portion side, respectively.

EFFECT OF THE INVENTION

According to the present invention, by the adoption of a metal plate having a normal thickness (normal thickness for the production of strikers, e.g., 3 millimeters) as an unprocessed plate material, a low-cost striker which has the aforementioned thickness and a round shape such as a circular shape in cross section can be achieved via a simple manufacturing operation with no substantial increase in weight of the striker. Moreover, by positioning the center of rotation of the hook on the mounting plate portion side, a base-plate portion of the striker, the distance of which from the center of rotation of the hook being short, can be made so as to come in contact with a leg portion of the hook (one of the leg portions which is pressed by the rod portion upon disengagement of the hook from the striker). Namely, the force exerted on the rod portion from the hook can be received by the base-plate portion of the striker, the distance of which from the center of rotation of the hook is short, and accordingly, the force exerted on the striker from the hook in the case where the force is exerted on the striker via the base-plate portion can be made smaller than in the case where the force is exerted on the striker via a folded-back plate portion of the striker. Therefore, the folded-back plate portion of the striker can be prevented from coming off the base plate portion. Furthermore, a reaction force (i.e., the force continuously exerted on a ratchet which locks the hook) when the engagement of the hook with the ratchet is disengaged by an operation of a door handle, or the like, can be reduced.

DESCRIPTION OF THE PREFERRED EMBODIMENTS

Figure 1:
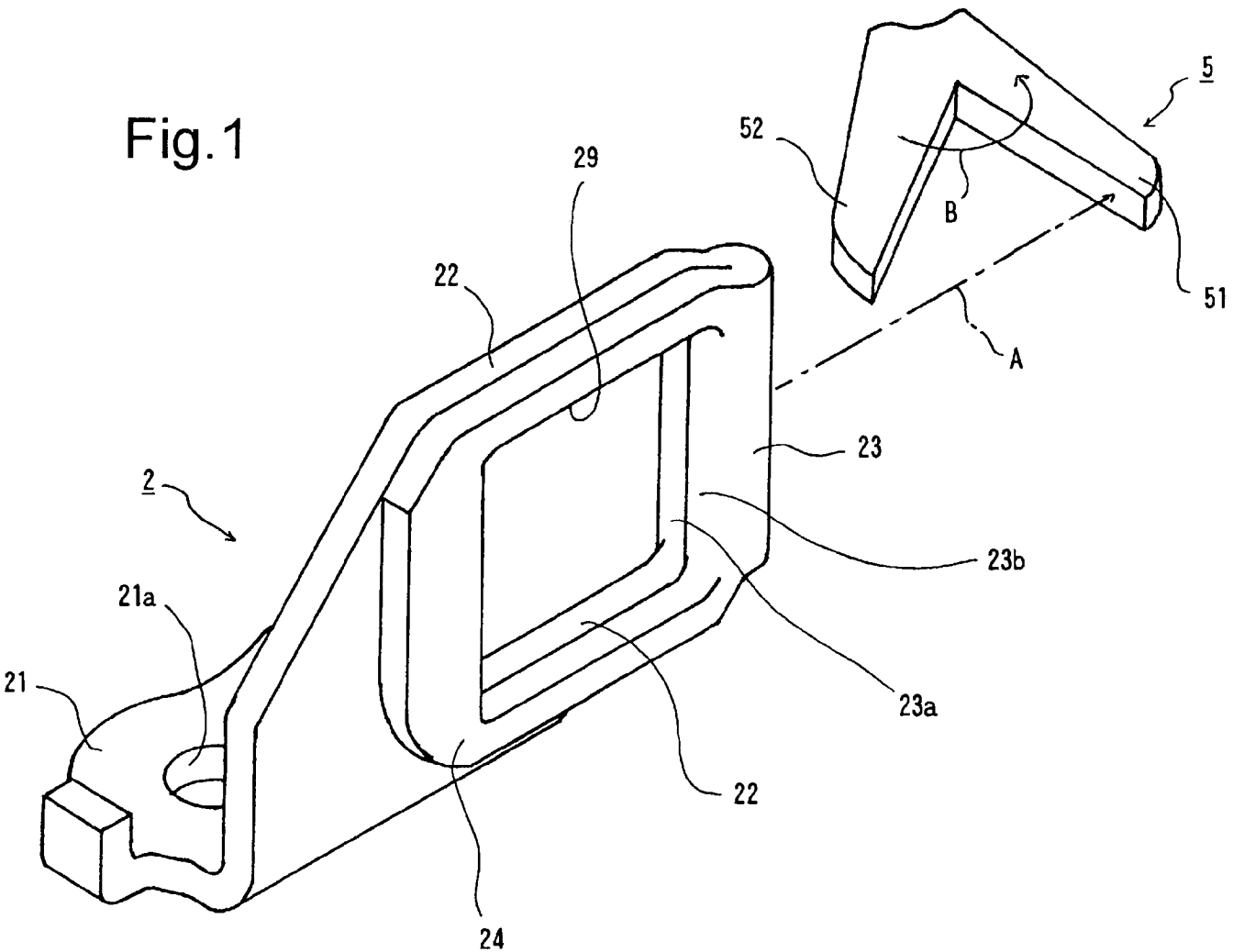
FIG. 1 is a perspective view of an embodiment of a striker system comprising a striker and a hook engageable with the striker, showing a positional relationship therebetween.
Figure 2:
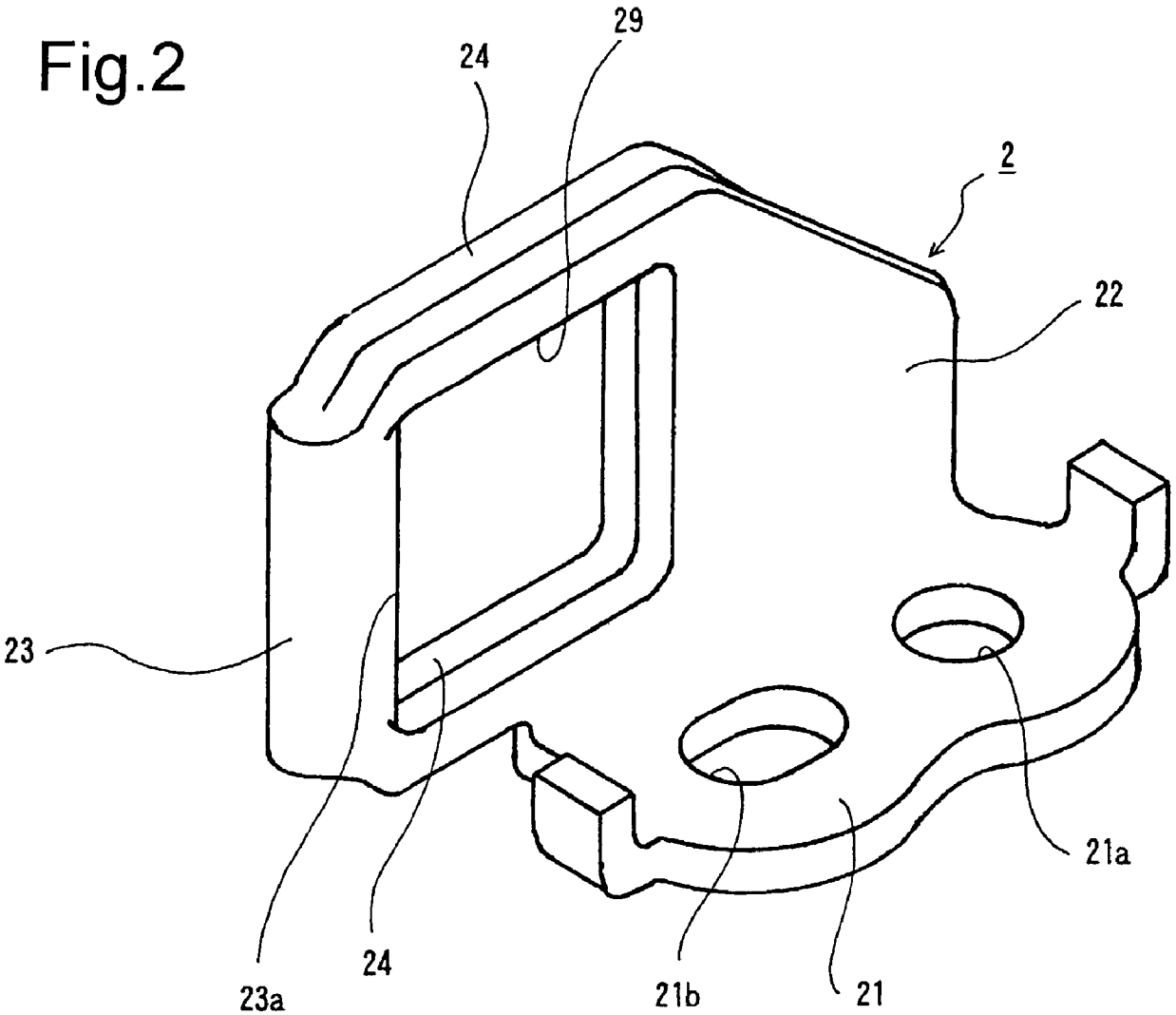
FIG. 2 is a perspective view of the striker shown in FIG. 1, viewed from the opposite side.

An embodiment of a striker according to the present invention will be hereinafter discussed with reference to FIGS. 1 through 4D. These drawings are schematic views illustrating the relative location between a hook 5 and a striker 2, and the force exerted on the striker 2 and a rod portion 23 thereof, so that the shapes of the hook 5 and the striker 2 shown in the drawings are different from the actual shapes thereof to some degree. Firstly, the relationship between the striker 2 and the hook 5 will be discussed hereinafter.

Figure 3B:
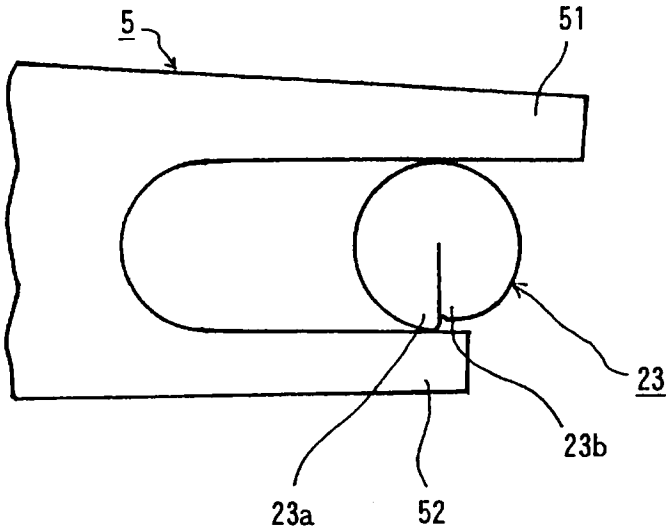
FIG. 3B is a schematic plan view of portions of the striker and the hook which are shown in FIG. 1 in a state where the striker and the hook are engaged with each other.
Figure 3A:
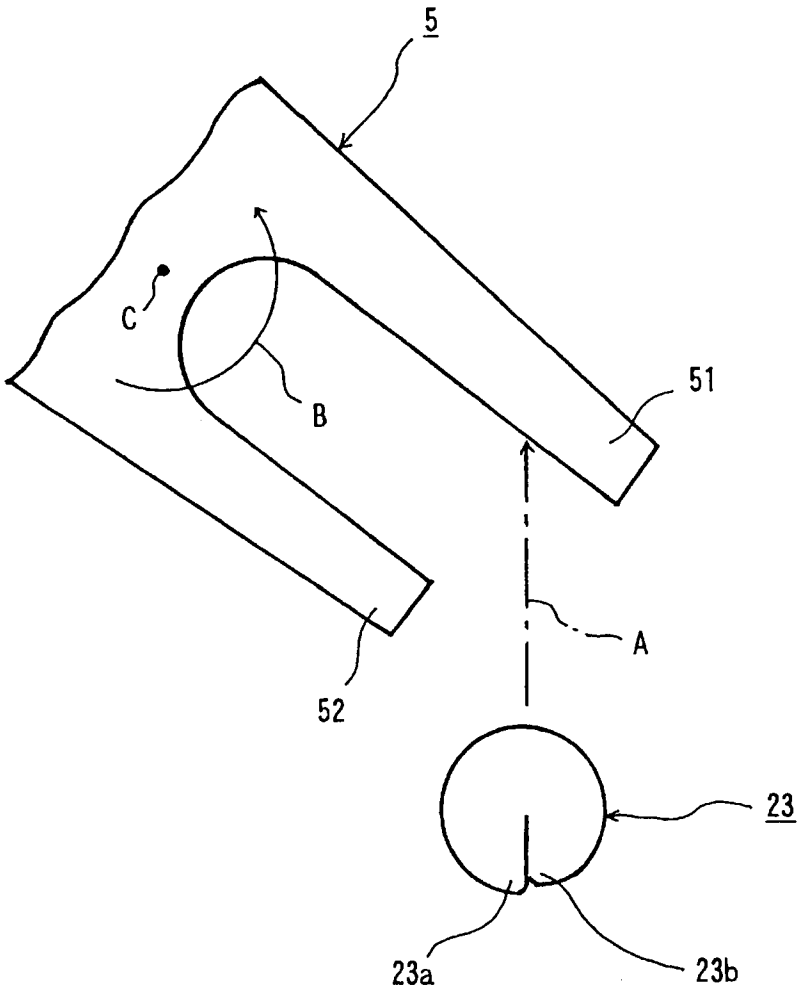
FIG. 3A is a schematic plan view of portions of the striker and the hook which are shown in FIG. 1 in a state before the striker and the hook are engaged with each other.
Figure 4A:
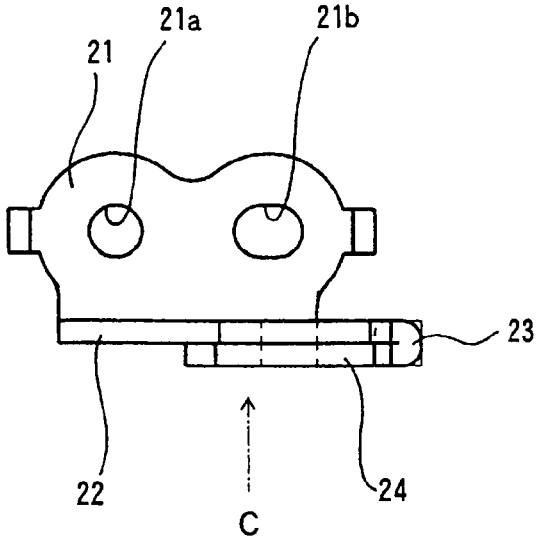
FIG. 4A is a plan view of the striker shown in FIG. 1, viewed from above the striker shown in FIG. 1.
Figure 4B:
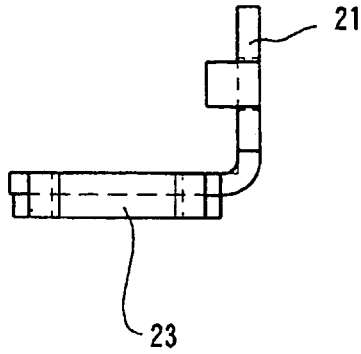
FIG. 4B is a side view of the striker shown in FIG. 1, viewed in the direction of an arrow B shown in FIG. 4C.
Figure 4C:
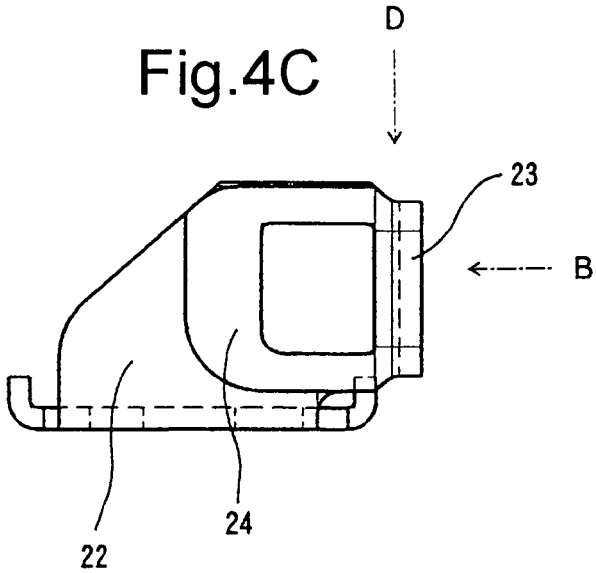
FIG. 4C is a front view of the striker shown in FIG. 1, viewed in the direction of an arrow C shown in FIG. 4A.
Figure 4D:
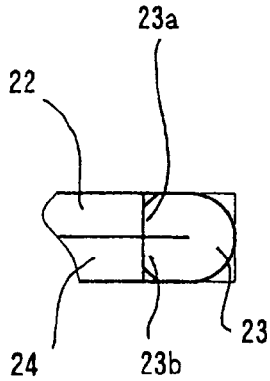
FIG. 4D is an enlarged view of a portion of the striker shown in FIG. 1, viewed in the direction of an arrow D shown in FIG. 4C.

The striker 2 can be brought into engagement with the hook 5 by moving the striker 2 into the hook 5 in the direction of an arrow A shown in FIGS. 1 and 3A, and further moving the striker 2 in the same direction while pressing a rear leg portion 51 of the hook 5 so that the hook 5 rotates in the direction of an arrow B to thereby engage the striker 2 in a groove (portion between the rear leg portion 51 and a front leg portion 52) of the hook 5. In a state where the striker 2 and the hook 5 are engaged with each other, the hook 5 is engaged with a ratchet (not shown) to be locked and held in this engaged state thereby. Additionally, in this engaged state, the striker 2 continuously exerts a force on the hook 5 due to a reaction force of a weather strip (not shown). In practice, the striker 2 does not move toward the hook 5 (in the direction of the arrow A) but the hook 5 moves toward the striker 2 (in the direction opposite to the direction of the arrow A). Upon the ratchet and the hook 5 being disengaged from each other by an operation of a door handle or the like, the hook 5 returns to its original position by the biasing force of a spring (not shown), thereby making it possible to disengage the hook 5 from the striker 2.

The structure of the striker 2 will be discussed hereinafter.

As shown in the drawings, the striker 2 is provided with a mounting plate portion 21, a base plate portion 22, a rod portion 23, a folded-back plate portion 24, and a through-hole 29.

The mounting plate portion 21 is fixed to one of two members (e.g., a member on a car body) by bolts through two holes 21*a* and 21*b* formed on the mounting plate portion 21. The other of the two members to which the hook 5 is fixed is, e.g., a member on a car door.

The base plate portion 22 is formed (bent) upright relative to the mounting plate portion 21 by a bending process. Although the bend line between the mounting plate portion 21 and the base plate portion 22 serves as a border line therebetween, the bend line is not shown in FIG. 2 because the bend of the striker 2 between the mounting plate portion 21 and the base plate portion 22 does not have a sharp angle.

The folded-back plate portion 24 is formed by folding over an extended portion which extends from one end of the base plate portion 22 (the right end as viewed in FIG. 1, the left end as viewed in FIG. 2 or the right end as viewed in FIGS. 4A and 4C) in a direction of the aforementioned bend line on the opposite side of the base plate portion 22 from the mounting plate portion (21) side so that the extended portion overlies the base plate portion 22. In all of the drawings, the folded-back plate portion 24 is shown as that which has been formed by folding over the aforementioned extended portion.

The through-hole 29 is formed (punched) by a hole-press operation with the base plate portion 22 and the folded-back plate portion 24 overlaid on each other so that the folded end portion (the right end portion as viewed in FIG. 4C) between the base plate portion 22 and the folded-back plate portion 24 remains as the rod portion 23. The rod portion 23 is used as an engaging portion engageable with the hook 5.

The portion 23 is formed so that a cross sectional shape thereof is substantially circular as shown in FIGS. 3A and 3B, and so that a base-plate portion 23*a* of the portion 23, which was continuous with the base plate portion 22 (i.e., shared the same surface) before the formation of the through-hole 29, becomes radially longer in cross section than a folded-back plate portion 23*b* of the portion 23, which was continuous with the folded-back plate portion 24 before formation of the through-hole 29.

Accordingly, in a state where the portion 23 has moved to the hook 5 in the direction of the arrow A to be engaged therewith, the base-plate portion 23*a* is in contact with the front leg portion 52 of the hook 5 while undergoing a force from the hook 5. In other words, the base-plate portion 23*a* exerts a force on the hook 5.

The force exerted on the striker 2 from the hook 5 (i.e., the force exerted on the hook 5 by the striker 2) in the case where the force is exerted on the striker 2 via the base-plate portion 23*a* is smaller than that in the case where the force is exerted on the striker 2 via the folded-back plate portion 23*b* because the distance between a center of rotation C of the hook 5 and the base-plate portion 23*a* is shorter than the distance between the center of rotation C of the hook 5 and the folded-back plate portion 23*b*.

Figure 5:
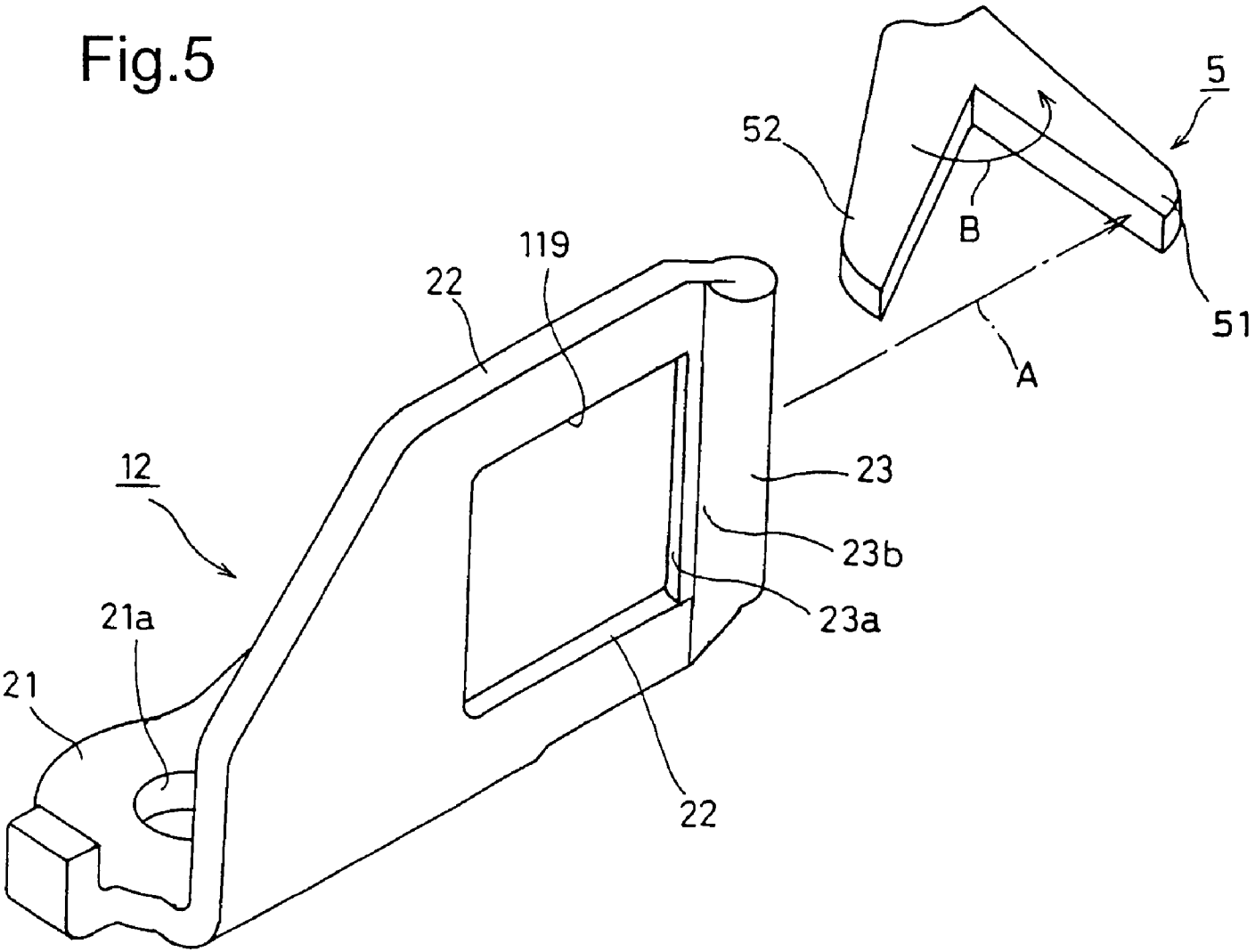
FIG. 5 is a perspective view of another embodiment of the striker system including the striker and the hook engageable with the striker, showing a positional relationship therebetween.
Figure 6B:
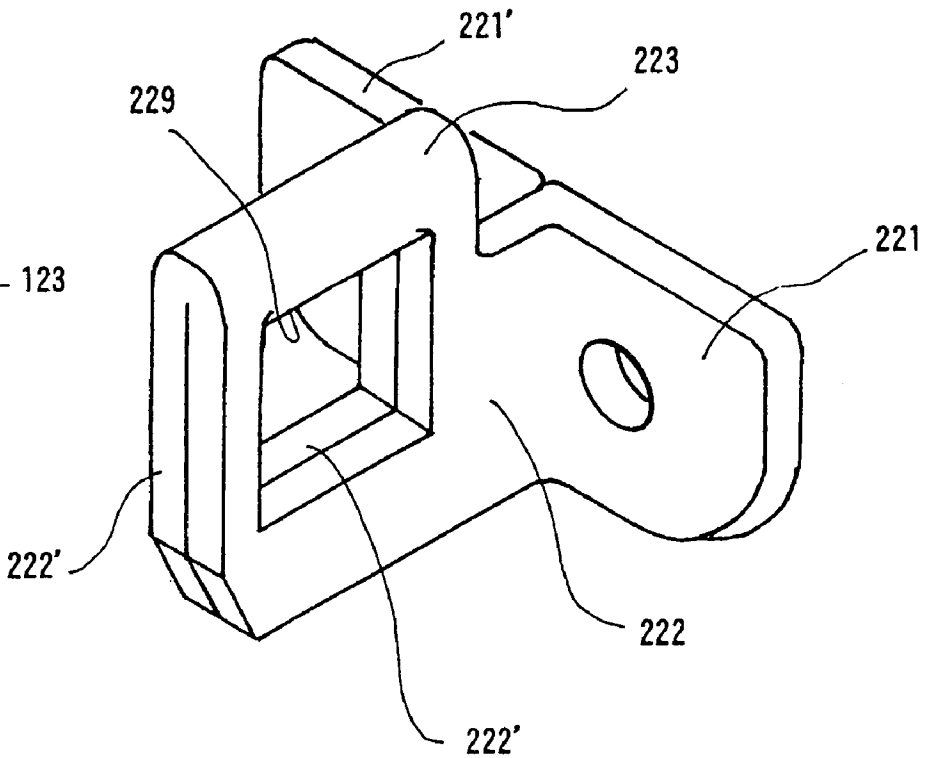
FIG. 6B is a perspective view of another conventional striker.
Figure 6A:
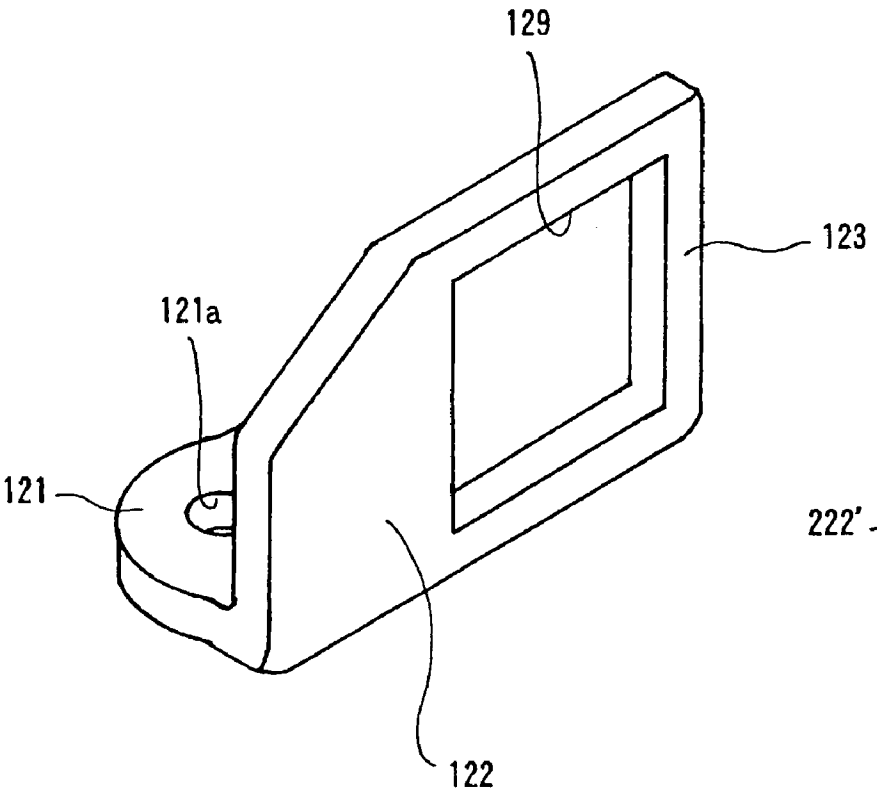
FIG. 6A is a perspective view of a conventional striker.

Accordingly, the striker 2 can secure a sufficient strength without being formed with a mounting plate portion such as the mounting plate portion 221' shown in FIG. 6B. Moreover, the folded-back plate portion 24 can be prevented from coming off the base plate portion 22 even if the folded-back plate portion 24 is not fixed to the base plate portion 22 by welding or adhering. Accordingly, the folded-back plate portion 24 can be provided only for the purpose of achieving the rod portion 24 having a circular shape in cross section with a required thickness while securing a sufficient thickness of the rod portion 23. For instance, another embodiment of a striker 12 shown in FIG. 5 is different from the striker 2 in that the striker 12 is provided with only the rod portion 23 and no folded-back plate portion corresponding to the folded-back plate portion 24 that lies on the base plate portion 22, even though the striker 12 is the same as the striker 2 in that an extended portion, which extends from one end of the base plate portion 22 in the direction of the aforementioned bend line, is folded over. To make a through-hole 119 in the striker 12, the base plate portion 22 only needs to be formed (punched) by a hole-press operation, which facilitates manufacture of the striker 12.

Furthermore, since the force exerted on the hook 5 from the striker 2 by reaction force of the aforementioned weather strip (not shown) to prevent backlash between the striker 2 and the hook 5 when the striker 2 and the hook 5 are engaged with each other is reduced, the force necessary for disengaging the ratchet which engages with the hook 5 to lock the same from the hook 5 by an operation of a door handle or the like (not shown) can be a relatively small force. Namely, the reaction force of the door when the door is pulled open can be reduced.

What is claimed is:

1. A striker for locking two members with each other by engagement of said striker with a groove of a hook, wherein said striker is fixed to one of said two members and said hook is rotatably fixed to the other of said two members, said striker comprising:

a mounting plate portion fixed to said one of said two members;

a base plate portion which is formed so as to extend perpendicular to said mounting plate portion by a bending process along a bend line; and a folded-back plate portion which is formed by folding over an extended portion, extending from one end of said base plate portion in a direction of said bend line, onto the opposite side of said base plate portion from said mounting plate portion side, so that said extended portion overlies said base plate portion, wherein said base plate portion is positioned closer to said hook than said folded-back plate portion, wherein a through-hole is formed in said base plate portion and said folded-back plate portion, which overlie each other, so that a folded end portion between said base plate portion and said folded-back plate portion defines a rod portion serving as an engaging portion engageable with a groove of said hook, and wherein a first portion of a cross section of said rod portion, at said folded end portion, which is taken along a plane orthogonal to the direction of the length of said rod portion is greater in length than a second portion of said cross section of said rod portion, said first portion and said second portion being provided on said base plate portion and said folded-back plate portion, respectively.

2. A striker for locking two members with each other by engagement of said striker with a groove of a hook, wherein said striker is fixed to one of said two members and said hook is rotatably fixed to the other of said two members, said striker comprising:

a mounting plate portion fixed to said one of said two members;

a base plate portion which is formed so as to extend perpendicular to said mounting plate portion by a bending process along a bend line; and a rod portion which is formed by folding over an extended portion, extending from one end of said base plate portion in a direction of said bend line, onto the opposite side of said base plate portion from said mounting plate portion side, so that the folded over said extended portion defines a folded-back plate portion, wherein said base plate portion is positioned closer to said hook than said folded-back plate portion, wherein a through-hole is formed in said base plate portion so as to define said rod portion, said rod portion serving as an engaging portion engageable with a groove of said hook, and wherein a first portion of a cross section of said rod portion, which is taken along a plane orthogonal to the direction of the length of said rod portion, is greater in length than a second portion of said cross section of said rod portion, said first portion being provided on said base plate portion and said second portion including said folded-back plate portion.

3. A striker for locking two members with each other by engagement of said striker with a groove of a hook, wherein said striker is fixed to one of said two members and said hook is rotatably fixed to the other of said two members, said striker comprising:

a mounting plate portion fixed to said one of said two members;

a base plate portion which is formed so as to extend perpendicular to said mounting plate portion by a bending process along a bend line; and a folded-back plate portion which is formed by folding over an extended portion extending from one end of said base plate portion in a direction of said bend line, onto the opposite side of said base plate portion from said mounting plate portion side, so that said extended portion overlies said base plate portion, wherein a through-hole is formed in said base plate portion and said folded-back plate portion, which overlie each other, so that a folded end portion between said base plate portion and said folded-back plate portion defines a rod portion serving as an engaging portion engageable with a groove of said hook, and wherein a first portion of a cross section of said rod portion, at said folded end portion, which is taken along a plane orthogonal to the direction of the length of said rod portion is greater in length than a second portion of said cross section of said red-like rod portion, a distance between said first portion and a center of rotation of said hook being shorter than a distance between said second portion and said center of rotation of said hook.

4. A striker for locking two members with each other by engagement of said striker with a groove of a hook, wherein said striker is fixed to one of said two members and said hook is rotatably fixed to the other of said two members, said striker comprising:

a mounting plate portion fixed to said one of said two members;

a base plate portion which is formed so as extend perpendicular to said mounting plate portion by a bending process along a bend line; and a rod portion which is formed by folding over an extended portion, extending from one end of said base plate portion in a direction of said bend line, onto the opposite side of said base plate portion from said mounting plate portion side, so that the folded over said extended portion defines a folded-back plate portion, wherein a through-hole is formed in said base plate portion so as to define said rod portion, said rod portion serving as an engaging portion engageable with a groove of said hook, and wherein a first portion of a cross section of said rod portion, which is taken along a plane orthogonal to the direction of the length of said rod portion, is greater in length than a second portion of said cross section of said rod portion, a distance between said first portion and a center of rotation of said hook being shorter than a distance between said second portion and said center of rotation of said hook.

5. A striker system comprising a striker and a hook, said system being for locking two members with each other by engagement of the striker with a groove of the hook, wherein said striker is fixed, in use, to a first of said two members and said hook is rotatably fixed, in use, to a second of said two members, the striker comprising:

a mounting plate portion fixed to said first member;

a perpendicular portion comprising a base plate portion which extends perpendicularly from one side for the mounting plate portion along a bend line, and an extended portion which extends from one end the base plate portion in a direction of said bend line and which is folded back to overlie the base plate portion on an opposite side of the base plate portion to the mounting plate portion to form a folded end of the perpendicular portion; and a through-hole formed in the perpendicular portion to define a rod portion at the folded end thereof for serving as an engaging portion for engaging with said groove of said hook;

wherein the part of the rod portion formed from the base-plate portion extends further into the through-hole than the part of the rod portion formed from the extended portion;

and wherein said striker and said hook are positioned so that said hook is located on a same side of said striker as said base plate portion.

6. A striker system according to claim 5 wherein the rod portion has a substantially circular cross-section, and wherein the part of the rod portion formed from the base-plate portion ha s a longer radius than the part of the rod portion formed from the extended portion.

7. A striker system according to claim 6 wherein said hook is mounted relative to the striker so that the part of the rod portion formed from the base-plate portion is positioned to be closer to the hook than the part of the rod portion formed from the extended portion.

8. A striker system according to claim 7 wherein the part of the rod portion formed from the base-plate portion is positioned to be closer to a center of rotation of the hook than the part of the rod portion formed from the extended portion.

9. A striker system according to claim 5 wherein said hook is mounted relative to the striker so that the part of the rod portion formed from the base-plate portion is positioned to be closer to the hook than the part of the rod portion formed from the extended portion.

10. A striker system according to claim 9 wherein the part of the rod portion formed from the base-plate portion is positioned to be closer to a center of rotation of the hook than the part of the rod portion formed from the extended portion.

* * * * *

UNITED STATES PATENT AND TRADEMARK OFFICE

CERTIFICATE OF CORRECTION

PATENT NO. : 7,399,012 B2
APPLICATION NO. : 10/574964
DATED : July 15, 2008
INVENTOR(S) : Yoshimura et al.

It is certified that error appears in the above-identified patent and that said Letters Patent is hereby corrected as shown below:

On the Title Page:
Section [12] reads "Yoshimura" should read --Yoshimura et al.--

Section [75] reads "Takeshi Yoshimura, Aichi (JP)" should read --Takeshi Yoshimura, Aichi (JP); Takumi Okada, Toyota-shi, Aichi-ken (JP); Jiro Inoue, Aichi-ken (JP); Toshiya Kaneko, Aichi-ken (JP)--.

Section [73] reads "Toyota Jidosha Kabushiki Kaisha, Aichi-Ken (JP); Mitsui Mining & Smelting Co., Ltd., Tokyo (JP); Shiroki Corporation, Kanagawa-Ken (JP)" should read --Shiroki Corporation, Kanagawa-Ken (JP); Toyota Jidosha Kabushiki Kaisha, Aichi-Ken (JP); Mitsui Mining & Smelting Co., Ltd., Tokyo (JP)--.

Column 7, line 22, delete "red-like".

Signed and Sealed this

Fourth Day of November, 2008

JON W. DUDAS
*Director of the United States Patent and Trademark Office*